US005609517A

United States Patent [19]

Lofaro

[11] Patent Number: 5,609,517

[45] Date of Patent: Mar. 11, 1997

[54] COMPOSITE POLISHING PAD

[75] Inventor: Michael F. Lofaro, Milton, N.Y.

[73] Assignee: International Business Machines Corporation, Armonk, N.Y.

[21] Appl. No.: 560,721

[22] Filed: Nov. 20, 1995

[51] Int. Cl.[6] ..... B24D 11/00

[52] U.S. Cl. ..... 451/529; 451/526; 451/527

[58] Field of Search ..... 451/526, 527, 451/528, 529, 537, 539; 15/230, 230.16, 230.18

[56] References Cited

U.S. PATENT DOCUMENTS

| | | | |
|---|---|---|---|
| 816,461 | 3/1906 | Gorton | 451/527 |
| 1,953,983 | 4/1934 | Benner | 51/280 |
| 2,001,911 | 5/1935 | Wooddell et al. | 451/529 |
| 2,952,951 | 7/1953 | Simpson | 451/529 |
| 5,177,908 | 1/1993 | Tuttle | 51/283 R |
| 5,212,910 | 5/1993 | Breivogel et al. | 51/398 |
| 5,230,184 | 7/1993 | Bukhman | 51/283 R |
| 5,297,364 | 3/1994 | Tuttle | 51/209 R |
| 5,329,734 | 7/1994 | Yu | 51/283 R |
| 5,396,737 | 3/1995 | Englund et al. | 451/28 |
| 5,403,228 | 4/1995 | Pasch | 451/259 |

FOREIGN PATENT DOCUMENTS

| | | | |
|---|---|---|---|
| 2267950 | 11/1990 | Japan | H01L 21/76 |

OTHER PUBLICATIONS

E. Mendel, "Process of Free Polishing Semiconductor Wafers", IBM Technical Disclosure Bulletin vol. 26, No. 7A, Dec. 1983, p. 3176.

Sumitomo Metal Industries presentation handout, May 16, 1994.

*Primary Examiner*—Bruce M. Kisliuk
*Assistant Examiner*—Dona C. Edwards
*Attorney, Agent, or Firm*—Alison D. Mortinger

[57] ABSTRACT

A composite polishing pad is provided, with a supporting layer, nodes attached to the supporting layer, and an upper layer attached to the supporting layer which surrounds but does not cover the nodes. The support layer, nodes, and upper layer may all be of different hardnesses.

13 Claims, 4 Drawing Sheets

COMPOSITE POLISHING PAD

FIELD OF THE INVENTION

This invention is directed generally to semiconductor processing, and more particularly to polishing pads used for mechanical or chemical-mechanical planarization of a semiconductor substrate.

BACKGROUND OF THE INVENTION

Chemical-mechanical polishing (CMP) is a method used in semiconductor processing to planarize step-like features on a wafer. With CMP, a wafer is pressed (upside down) against a rotating polishing pad in the presence of a chemically corrosive slurry. The action of the slurry and the rotary motion combine to remove a desired amount of material from the wafer and achieve a planar surface.

The main goal for a typical CMP process is a high degree of flatness or planarity. Planarity both locally (for closely spaced features) and globally (i.e. uniformity across the wafer) are very important. This is made difficult by the fact that wafers are often not flat to begin with, and during processing, features of various sizes and densities are created across the wafer.

Commercially available polishing pads come in a variety of hardness types. Soft pads can more easily conform to the different features on the wafer and tend to achieve global planarity at the expense of local planarity, while hard pads conform less and tend to achieve local planarity at the expense of global planarity. Soft pads also tend to polish away material more slowly, given the same speed and pressure as a hard pad, but produce less scratching than a hard pad. Soft pads also provide a better vehicle than hard pads for delivering slurry to the polishing site, as the slurry can soak into the soft pad material.

Composite pads have been created to attempt to combine the best features of soft and hard pads. Two examples are "sandwich" types which use vertical stacking of hard and soft layers (see U.S. Pat. No. 5,212,910 to Breivogel, et al.), and "distributed" types which attach hard pieces to a soft support layer (see U.S. Pat. No. 5,230,184 to Bukhman). However, these types of composite pads tend to degrade easily over time as the pads wear, the soft material tends to lose its elasticity, and the pad becomes loaded with polish residuals and slurry. Pad conditioning (scraping away the top layer) thus is required more frequently. As a result, pad life is further shortened and process stability and reliability suffers.

Thus, there remains a need for a composite polishing pad that provides local and global planarity, extended pad life, and good slurry delivery.

SUMMARY OF THE INVENTION

It is therefore an object of the present invention to provide a composite polishing pad that achieves local and global planarity.

It is a further object to provide a pad with an improved operating life.

It is another object to provide a pad which enables improved slurry transport to the surface being polished.

In accordance with the above listed and other objects, a composite polishing pad is provided with a supporting layer, nodes attached to the supporting layer, and an upper layer attached to the supporting layer which surrounds but does not cover the nodes. The support layer, nodes, and upper layer may all be of different hardnesses.

BRIEF DESCRIPTION OF THE DRAWINGS

These and other features, aspects, and advantages will be more readily apparent and better understood from the following detailed description of the invention, in which.

DESCRIPTION OF THE PREFERRED EMBODIMENTS

Figure 1:
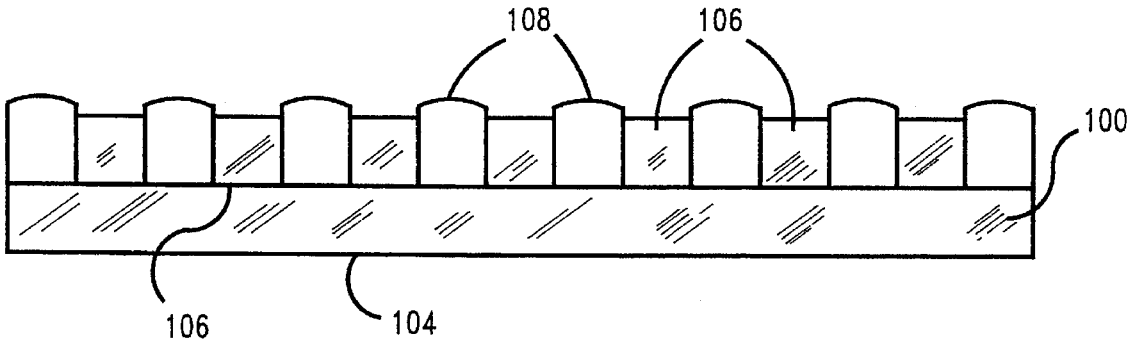
FIG. 1 is a sectional view of the composite polishing pad.

Referring now to the drawings and more particularly to FIG. 1, a sectional view of the composite polishing pad is shown. A support layer 100 with an upper surface 102 and a lower surface 104 has nodes 106 attached to upper surface 102. Note that nodes 106 may be integral with support layer 100 (e.g. formed at the same time) or attached in a separate manufacturing step. Upper layer 108 is attached to support layer 100 such that upper layer 108 surrounds nodes 106, with the top surface of nodes 106 not covered by upper layer 108.

Nodes 106 and upper layer 108 are made of materials of different hardness types. As shown in FIG. 1, with layer 108 extending farther from surface 102 than nodes 106, layer 108 is softer than nodes 106. When a wafer is pressed against the pad for polishing, layer 108 compresses more than nodes 106, so that the wafer is contacts both layer 108 and nodes 106 at the same time, i.e. they are substantially coplanar. Note that harder nodes 106 may also compress to some degree, depending on the material chosen. Support layer 100 may be either relatively soft or relatively hard, depending on polishing process requirements, and may be the same or different hardness as nodes 106 or layer 108.

Figure 2:
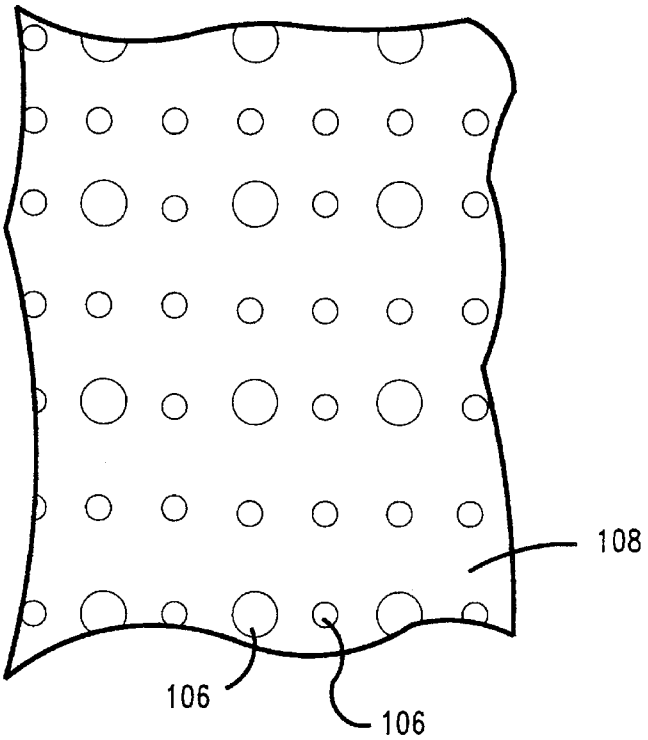
FIG. 2 is a top view of the composite polishing pad.

FIG. 2 is a top view of a portion of the composite polishing pad, where nodes 106 are surrounded by layer 108. As shown, nodes 106 are round, but may be of any desired shape or size, and may vary in shape and size across the pad, depending on process conditions. Node spacing may also vary. In general, with a soft upper layer 108, excessive space between nodes will result in local pad deformation depending on the surface topology of the wafer being polished. However if the inter-node spaces are too small, then the benefit of the soft pad (less scratching, better global planarity) will not be realized.

Figure 3A:
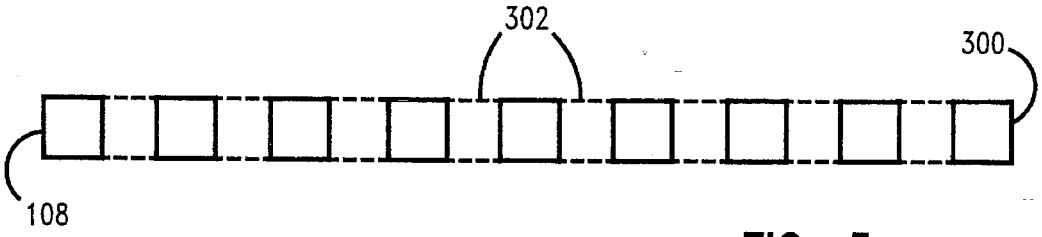
FIGS. 3(*a*), 3(*b*), and 3(*c*) illustrate a method of manufacturing the composite polishing pad.
Figure 3B:
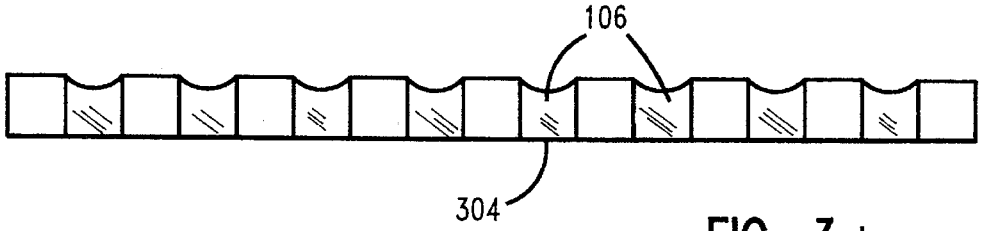
Figure 3C:
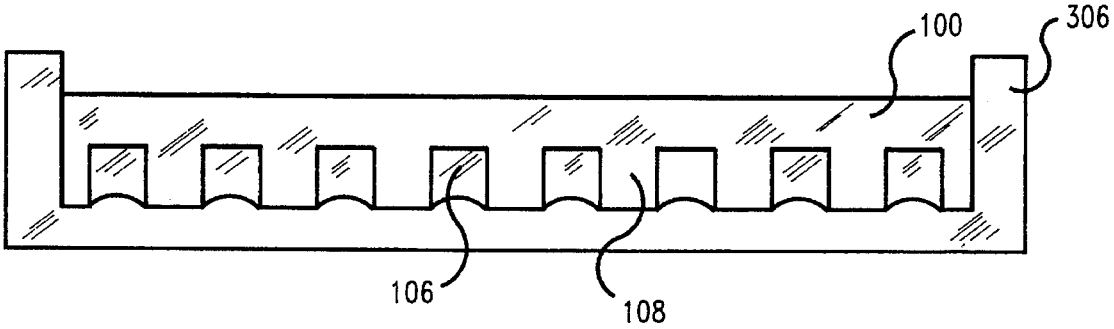

FIGS. 3(*a*), 3(*b*), and 3(*c*) illustrate one method of manufacturing a composite polishing pad with a hard support layer, soft upper layer, and hard nodes. FIG. 3(*a*) shows a soft pad material 300 with holes 302 formed therein (for example by punching or drilling) to form upper layer 108. In FIG. 3(*b*), a liquid polymer 304 is then poured into holes 302 which when hardened forms nodes 106. A two-part polymer of resin and hardener may be used, and the ratio of resin to hardener altered to achieve differing degrees of elasticity. Note that upper layer 108 may be temporarily attached to a backing or otherwise positioned so that the polymer does not spread out underneath upper layer 108. In FIG. 3(*c*), upper layer 108 with nodes 106 is then placed upside down in a mold 306 to form support layer 100 by adding more liquid polymer to the desired thickness.

Several variations in the manufacturing process are possible. For example, with a suitable mold, upper layer 108 (with holes 302) may be put in mold 306 and nodes 106 and support layer 100 poured at the same time. Note that upper layer 108 should be slightly compressed so that when the completed pad is removed from the mold, layer 108 will extend slightly above nodes 106 as in FIG. 1. Alternately, support layer 100 may be formed first, upper layer 108 (with holes) attached, and nodes 106 created last. A translucent material may optionally be used to form support layer 100 and noes 106 so that optical endpoint detection methods may be used to determine when the polishing process is complete. A hole may also be formed in support layer 100 to further enable optical endpoint detection.

Figure 4A:
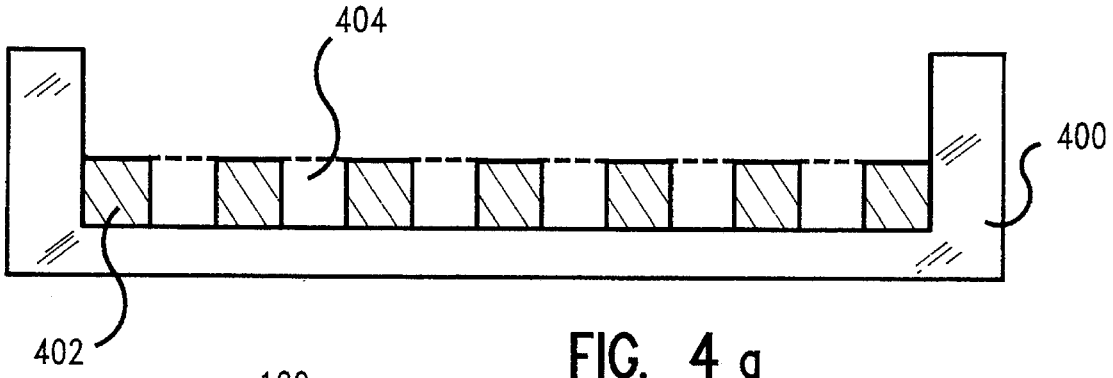
FIGS. 4(*a*), 4(*b*), and 4(*c*) illustrate an alternate method of manufacturing the composite polishing pad.
Figure 4B:
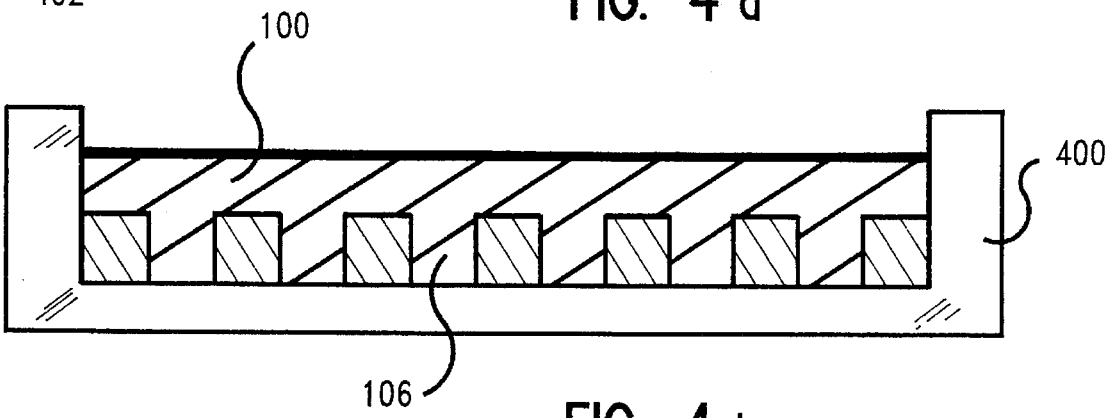
Figure 4C:
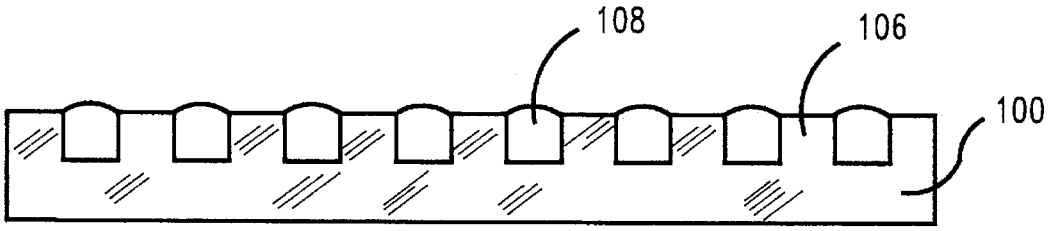

FIGS. 4(*a*), 4(*b*), and 4(*c*) illustrate another method of manufacturing a composite polishing pad with a hard support layer, soft upper layer, and hard nodes. In FIG. 4(*a*), a mold 400 is shown for first forming a hard support layer and hard nodes. A node pattern sheet 402 is placed in the bottom of mold 400. Node pattern sheet 402 has holes 404 defining the desired node pattern, and sheet 402 may be coated or sprayed with a lubricant.

In FIG. 4(*b*), a liquid polymer (as in FIG. 3(*b*)) has been poured into mold 400. Nodes 106 form in holes 404, with a thickness roughly equal to the thickness of pattern sheet 402. Support layer 100 is also formed using the mold, either at the same time as nodes 106 by pouring in additional polymer, or by adding a different polymer mix. Alternately, a separate layer of material can be pressed into the mold to attach to nodes 106 while they are still soft (not shown). In FIG. 4(*c*), support layer 100 with nodes 106 has been removed from the mold. Upper layer 108 is then formed by applying a soft material to the support layer such that nodes 106 remain uncovered. For example, a urethane foam can be sprayed on and squeegeed to leave the desired amount of soft material in between the nodes, and when the urethane hardens it expands somewhat to form a soft upper layer 108 which extends slightly beyond (without covering) nodes 106.

Figure 5A:
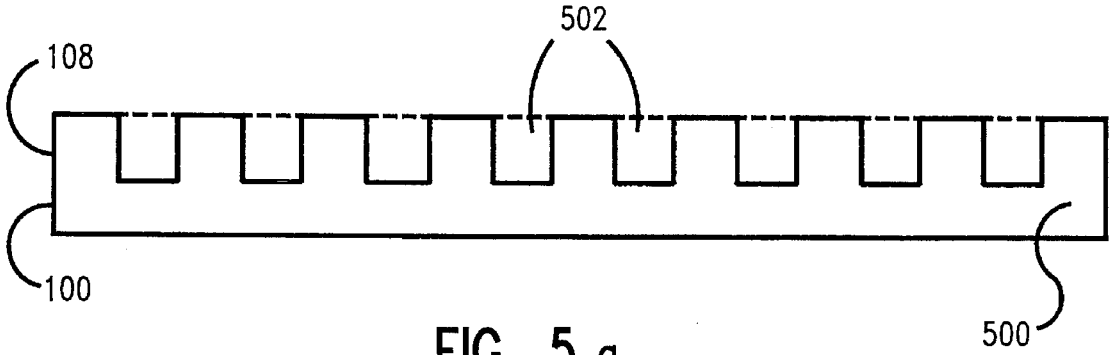
FIGS. 5(*a*), and 5(*b*) illustrates another alternate method of manufacturing the composite polishing pad, all in accordance with the present invention.
Figure 5B:
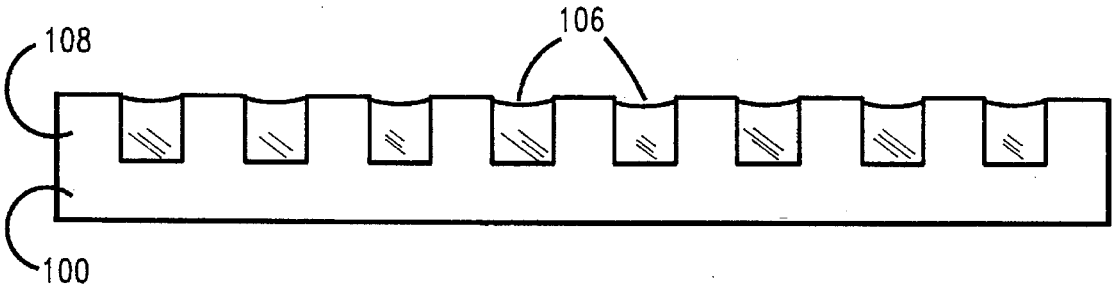

FIG. 5(*a*) illustrates one method of manufacturing a composite polishing pad with a soft support layer, soft upper layer, and hard nodes. A soft pad material 500 with depressions 502 formed therein (by drilling, for example) forms both support layer 100 and upper layer 108. Alternately, two separate soft pads, one with holes and one without, may be layered to form support layer 100 and upper layer 108. In FIG. 5(*b*), liquid polymer is then poured into depressions 502 to form nodes 106.

A sample composite polishing pad was constructed using the method illustrated in FIGS. 3(*a*) and 3(*b*), with a soft Politex pad (made by Rodel), and a two-part Envirotex polymer (made by Envirotex), in a 50/50 ratio of resin/hardener. Nodes 106 were square, 0.125" on a side, approximately 0.0625" thick, and spaced 0.75" center to center. Upper layer 108 was slightly greater than 0.0625" thick, and support layer 100 was about 0.125" thick. Sample wafers were run with an unmodified Politex pad and the composite pad. The composite pad showed an increase in planarity of a polished wafer of 2.3× with good uniformity observed.

While the composite polishing pad has the advantage of providing excellent slurry distribution through the soft upper layer which contacts the wafer, the pad may also be used for mechanical planarization without the use of a slurry. Another significant advantage is less down time and increased throughput for the chemical-mechanical planarization process. A typical standard pad process involves using a relatively hard pad to aggressively remove material and planarize the wafer, followed by using a relatively soft pad to buff the wafer and remove scratches. With the composite pad, the wafer is protected from scratches by the soft upper layer and supported by the hard nodes for good planarization. Thus there is no need to switch pads on one machine or use two machines with two different pads. Pad life is also extended because hard portions of the pad provide support for the soft portions. Thus the soft portions will not wear as easily, will not be compressed excessively so as to lose their elasticity, and polishing residuals will not be ground into the pad material.

In summary, a composite polishing pad has been described which combines the advantages of hard and soft pads. The composite pad is capable of achieving both local and global planarity, has an improved operating life versus standard pads, and enables good slurry transport to the surface being polished.

While the invention has been described in terms of specific embodiments, it is evident in view of the foregoing description that numerous alternatives, modifications and variations will be apparent to those skilled in the art. Thus, the invention is intended to encompass all such alternatives, modifications and variations which fall within the scope and spirit of the invention and the appended claims.

What is claimed is:

1. A composite polishing pad for polishing semiconductor wafers, comprising:

a supporting layer of a first hardness type, the supporting layer having an upper and a lower surface;

a plurality of nodes of a second hardness type attached to the upper surface of the supporting layer;

an upper layer of a third hardness type attached to the upper surface of the supporting layer, the upper layer surrounding but not covering the plurality of nodes, and the upper layer having a height greater than the nodes.

2. The composite polishing pad of claim 1 wherein the upper layer and the plurality of nodes compress to be approximately coplanar to each other during polishing.

3. The polishing pad of claim 1 wherein the first and second hardness types are substantially harder than the third hardness type.

4. The polishing type of claim 3 wherein the supporting layer is a polymer.

5. The polishing pad of claim 3 wherein the first and second hardness types are approximately the same.

6. The polishing pad of claim 1 wherein the second hardness type is substantially harder than the first and third hardness types.

7. The polishing pad of claim 6 wherein the first and third hardness types are approximately the same.

8. The polishing pad of claim 1 wherein the nodes are of non-uniform size.

9. The polishing pad of claim 1 wherein the nodes are of uniform size.

10. The polishing pad of claim 1 wherein the support layer and the nodes are formed at the same time.

11. The polishing pad of claim 1 wherein the support layer and the upper layer are formed at the same time.

12. The polishing pad of claim 1 wherein the supporting layer and nodes are translucent.

13. A composite polishing pad for polishing semiconductor wafers, comprising:

a translucent supporting layer of a first hardness type, the supporting layer having an upper and a lower surface;

a plurality of translucent nodes of a second hardness type attached to the upper surface of the supporting layer;

an upper layer of a third hardness type substantially less hard than the first and second hardness types, the upper layer attached to the upper surface of the supporting layer, and the upper layer surrounding but not covering the plurality of nodes.

* * * * *